United States Patent [19]

Gutridge

[11] 4,195,576

[45] Apr. 1, 1980

[54] MONORAIL CAR STABILIZING SYSTEM

[75] Inventor: Jack E. Gutridge, Dyer, Ind.

[73] Assignee: Pullman Incorporated, Chicago, Ill.

[21] Appl. No.: 29,221

[22] Filed: Apr. 12, 1979

Related U.S. Application Data

[63] Continuation-in-part of Ser. No. 670,603, Mar. 26, 1976, abandoned.

[51] Int. Cl.[2] ..... B61B 3/02; B61B 13/04; B61C 3/00; B61C 13/04

[52] U.S. Cl. ..... 105/147; 104/121; 105/150; 188/43; 191/30; 191/35; 267/3; 295/9 R

[58] Field of Search ..... 104/89, 95, 118, 121, 104/123, 125; 105/133, 141, 144, 145, 146, 147, 148, 149, 150, 156, 164, 171, 199 R; 180/33; 188/43; 191/23 A, 25, 30, 32, 35; 267/65; 280/709; 295/9 R

[56] References Cited

U.S. PATENT DOCUMENTS

| | | | |
|---|---|---|---|
| 154,890 | 9/1874 | Neal | 295/9 R |
| 512,535 | 1/1894 | Boynton | 191/30 |
| 780,214 | 1/1905 | Monnier | 105/147 X |
| 784,269 | 3/1905 | Monnier | 104/121 |
| 845,459 | 2/1907 | Gilstrap | 104/121 X |
| 1,105,540 | 7/1914 | Spelling | 105/146 |
| 1,369,839 | 3/1921 | Rowe | 295/9 R |
| 1,454,804 | 5/1923 | Wright | 105/145 X |
| 1,761,824 | 6/1930 | Goodrich | 104/118 |
| 1,947,119 | 2/1934 | Walter | 105/141 |
| 1,993,456 | 3/1935 | Roscher | 104/121 |
| 2,095,677 | 10/1937 | Schoepf et al. | 105/164 |
| 2,178,351 | 10/1939 | Tetens | 105/141 |
| 2,474,471 | 6/1949 | Dolan | 105/164 |
| 2,670,201 | 2/1954 | Rossman | 267/65 |
| 2,687,099 | 8/1954 | MacVeigh | 105/171 X |
| 3,001,484 | 9/1961 | Bingham | 105/145 |
| 3,121,402 | 2/1964 | Julien | 105/171 |
| 3,124,007 | 3/1964 | Swinney | 180/33 X |
| 3,238,894 | 3/1966 | Maksim, Jr. | 104/121 |
| 3,339,031 | 8/1967 | Rodeseike | 191/30 |
| 3,361,084 | 1/1968 | Ellzey | 104/89 X |
| 3,376,830 | 4/1968 | Bingham | 105/145 X |
| 3,433,177 | 3/1969 | Cripe | 105/199 R X |
| 3,525,306 | 8/1970 | Edel et al. | 105/150 X |
| 3,631,807 | 1/1972 | Cherto | 104/125 |
| 3,690,266 | 9/1972 | Mayo | 104/125 |
| 3,807,532 | 4/1974 | Molt | 188/43 |
| 3,841,653 | 10/1974 | Strauff | 280/709 |

*Primary Examiner*—Joseph F. Peters, Jr.
*Assistant Examiner*—Howard Beltran
*Attorney, Agent, or Firm*—Stephen D. Geimer

[57] ABSTRACT

A rail vehicle is disclosed for use on an elevated electric rail system having a lower rail below the vehicle and an upper rail above the vehicle. The vehicle includes a pair of lower wheels having independently rotatable flanges rollably carrying a vehicle cab along the lower rail and an upper wheel having independently rotatable flanges rollably engaging the upper rail. Electric motors, energized through contacts carried on the vehicle by an electric circuit associated with the upper rail, are drivingly connected through drive belts to the respective lower wheel to propel the vehicle along the rail system. The vehicle also includes a clamping rail brake carried by a vehicle which is engagable on the lower rail, and a vertically and laterally extendable servo system secured to the vehicle and carrying the upper wheel.

18 Claims, 10 Drawing Figures

FIG. 6
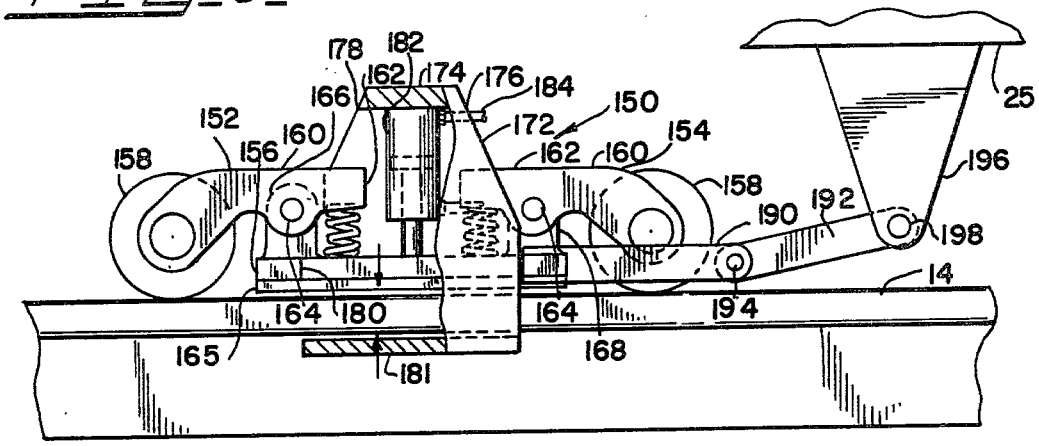
FIG. 7
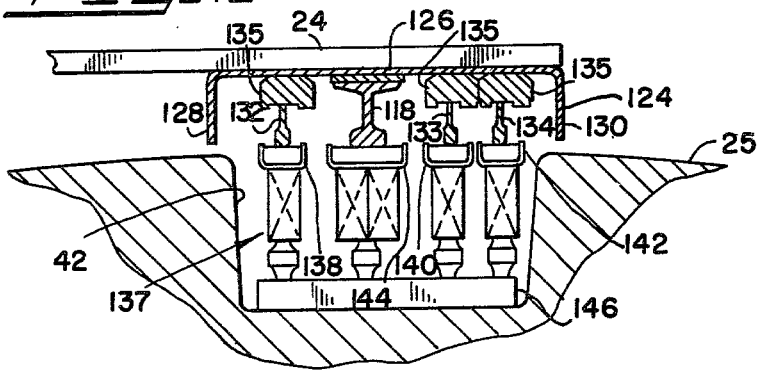
FIG. 9
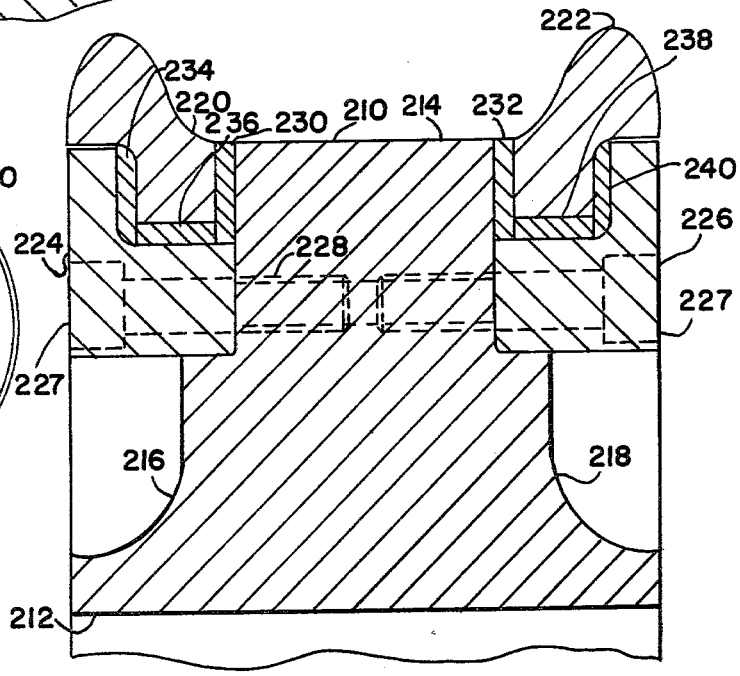
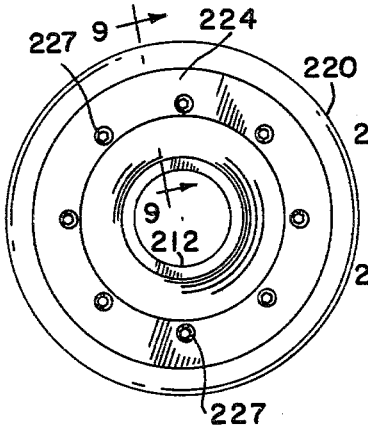
FIG. 8

MONORAIL CAR STABILIZING SYSTEM

CROSS REFERENCE TO RELATED APPLICATION

This application is a continuation-in-part application of parent application Ser. No. 670,603 filed Mar. 26, 1976, now abandoned.

BACKGROUND OF THE INVENTION

1. Field of the Invention

The present invention relates to personal rapid transit (PRT) systems of the vertical rail type and more particularly to rail vehicles employed in such systems.

2. Description of the Prior Art

Rapid transit systems which include rail vehicles movable over vertically arrayed rails have been known for some time, as exemplified by U.S. Pat. No. 1,993,456. The rail vehicles employed in such systems generally require an upper stabilizing wheel which mates with an upper rail of the rail system. The upper stabilizing wheel is usually biased against the upper rail to a predetermined extent to avoid derailments and insure that adequate traction for movement of the vehicle is always obtainable. However, by use of such fixed predetermined bias, the diverse traction conditions required for optimum vehicle operation over different track conditions (e.g. level, sloped, curved) are not obtainable.

Another drawback is such prior art vehicles have their vulnerability to the effect of centrifugal force on cargo and passengers carried thereon during movement over curved sections of the rail systems, which is intensified by the high speed of travel over such curves. Such centrifugal forces tend to shift the cargo and passengers radially outward relative to the curve of travel, and if excessive, can produce tremendous stress on the rail system with derailment as a possible consequence.

SUMMARY OF THE INVENTION

The present invention is summarized in that a rail vehicle operable between a lower tractive rail and an upper stabilizing rail of a rail system includes a cab, wheel means supporting the cab for rotatable movement on the lower tractive rail, an upper stabilizing wheel on the cab and being positioned for rotatable contact with the upper stabilizing rail, and means laterally positioning the upper stabilizing wheel relative to the cab whereby the cab may be laterally tilted relative to the upper rail to counteract the effect of centrifugal force thereon during movement along the rail system.

It is an object of the present invention to eliminate side sway and thereby stabilize a rail vehicle moving over a curve at high speed by neutralizing the effect of centrifugal force on the vehicle.

It is another object of the present invention to controllably vary the wheel traction of a rail vehicle in accordance with conditions encountered in transit.

Another object of the invention is to increase the acceleration, deceleration and braking abilities of a rail vehicle enabling high speed operation under high vehicle density conditions.

Still another object of the present invention is to increase the hill climbing ability of rail vehicles.

A further object of the present invention is to simplify fabrication and maintainance of vertical rail vehicles by use of a belt drive system in place of the differential and 90° gear drive system commonly employed in such vehicles.

Another object of this invention is to construct an upper rail reinforcing shroud which additionally serves as a weather protector for electrical contacts supported thereby.

Other objects and advantages of the present invention will become apparent from the following description of the preferred embodiment taken in conjunction with the accompanying drawings.

BRIEF DESCRIPTION OF THE DRAWINGS

FIG. 6 is a side elevation view with parts broken away of a clamping rail brake assembly for the rail vehicle of FIG. 1;

FIG. 7 is an enlarged partial cross section view of the upper rail and associated electrical contacts and a vehicle mounted and electrical pick-up assembly taken along the line 7—7 of FIG. 1;

FIG. 8 is a side elevation view of a wheel employed in the vehicle of FIG. 1;

FIG. 9 is an enlarged cross section view of the wheel of FIG. 8 taken along the line 9—9 thereof.

DESCRIPTION OF THE PREFERRED EMBODIMENT

Figure 1:
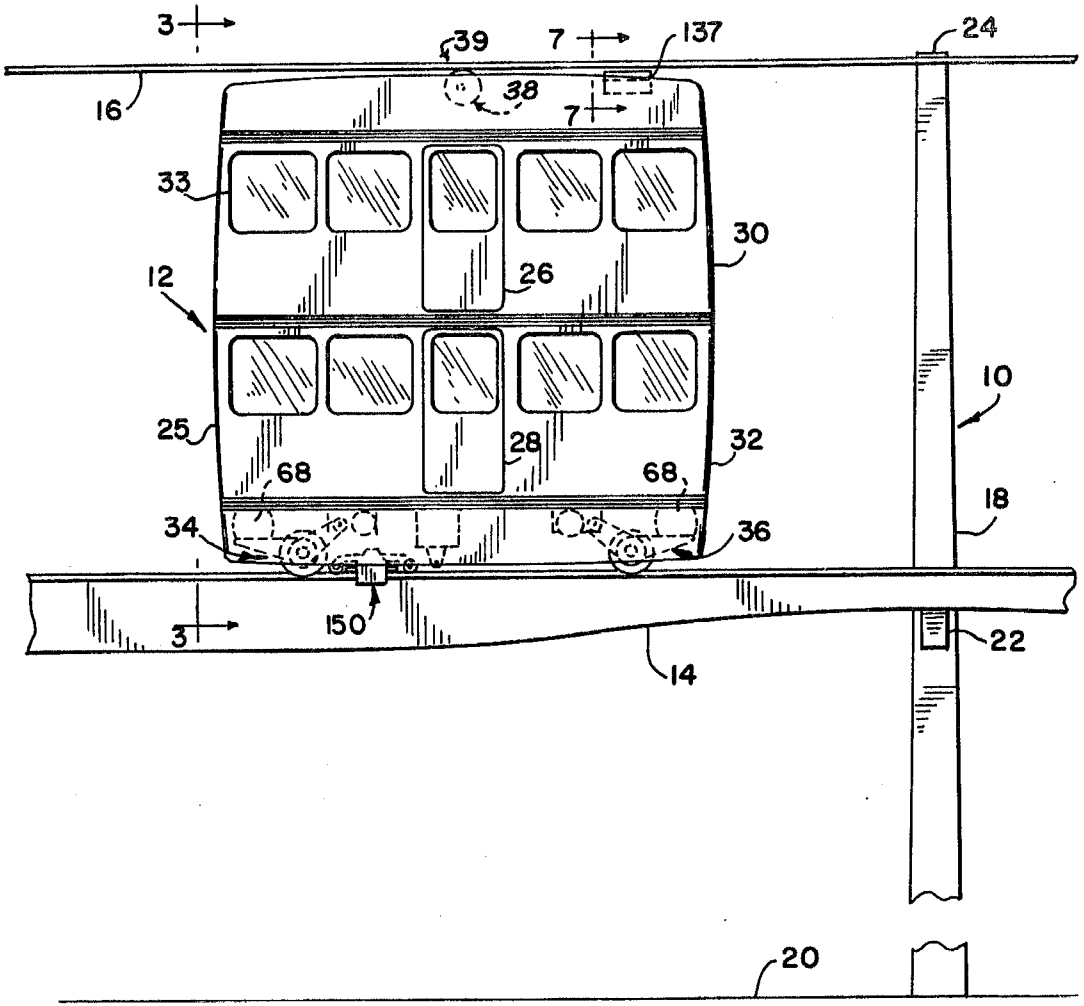
FIG. 1 is a side elevation view of an elevated rail system and rail vehicle supported thereon in accordance with the present invention.
Figure 2:
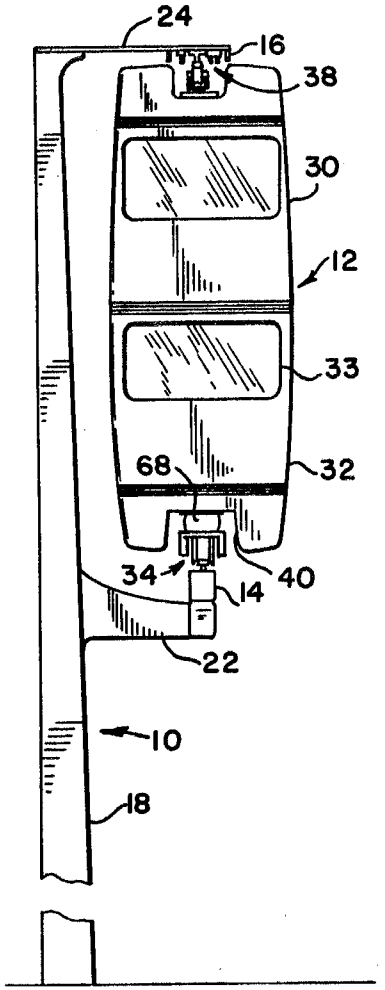
FIG. 2 is a rear elevation view of the elevated rail system and rail vehicle of FIG. 1.

As illustrated in FIGS. 1 and 2, a personal rapid transit system according to the present invention includes an elevated electric rail assembly 10 having one or more rail vehicles, such as indicated by 12, movably disposed thereon. Rail assembly includes a bottom running tractive rail 14 disposed beneath and supporting the weight of the vehicle 12 thereon, and an upper stabilizing rail 16 disposed above the vehicle 12 in vertical alignment with tractive rail 14. The lower and upper rails 14 and 16 are supported in mid-air at spaced apart points therealong by a plurality of support points 18, only one of which is shown. Each support post 18 is fixedly anchored to the ground 20 or other suitable base and includes a pair of arms 22 and 24 extending horizontally therefrom to which the rails 14 and 16 are attached.

The vehicle 12 includes a cab 25 having a double-deck construction. The cab 25 includes a pair of vertically stacked passenger or cargo loading entrances 26 and 28 serving respective upper and lower decks 30 and 32 thereof and may also include windows 33 for passenger viewing. It should be obvious that the vehicle 12 could also be a single deck construction, if desired, with an appropriate reduction in the spacing between the rails 14 and 16. The advantage of double-decking is to double the passenger or load capacity without a commensurate increase in car length.

Figure 3:
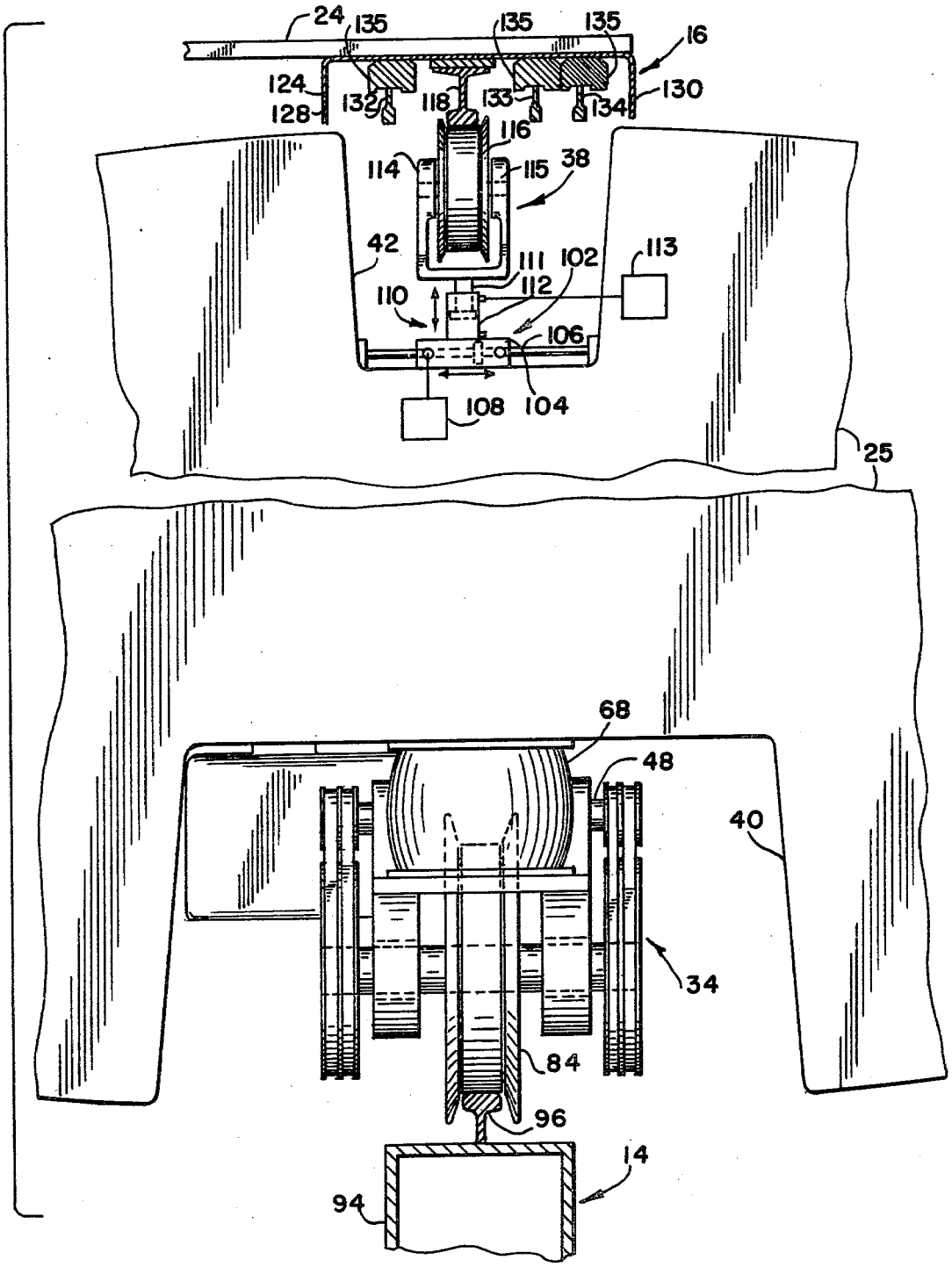
FIG. 3 is an enlarged partial cross section view with portions removed of an upper rail and wheel assembly and a lower rail and running gear assembly taken along the line 3—3 of FIG. 1.
Figure 5:
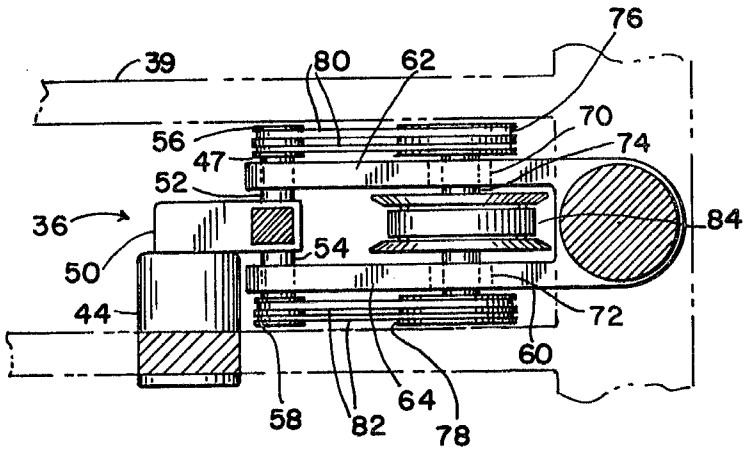
FIG. 5 is a top plan view with portions removed of the lower running gear assemblies of FIG. 4.
Figure 5:
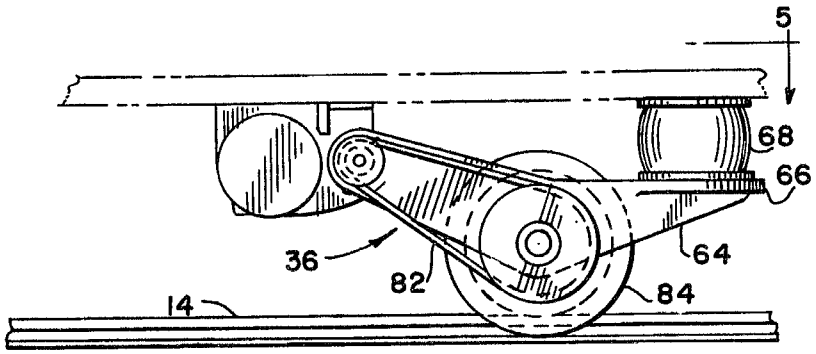
Figure 5:
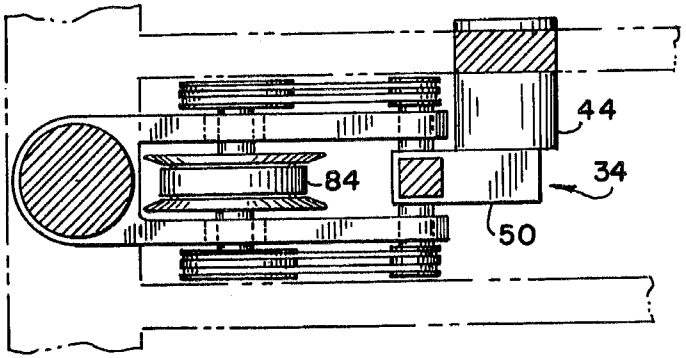
Figure 4:
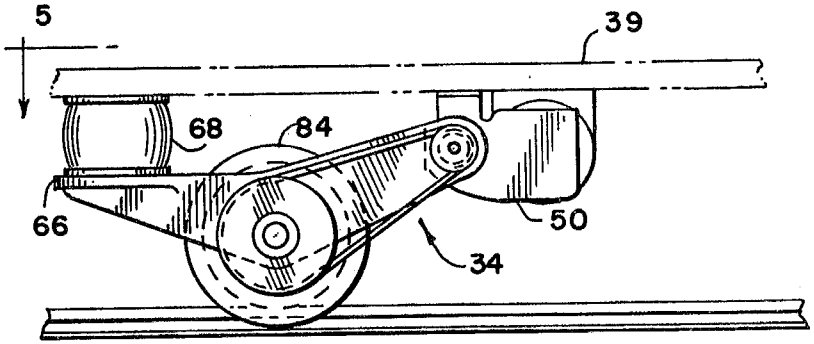
FIG. 4 is a side elevation view of the lower running gear assemblies of the rail vehicle of FIG. 1.

Vehicle 12 also includes a pair of lower running gear assemblies 34 and 36 rollably disposed on bottom rail 14 and an upper wheel assembly 38 in contact with upper rail 16, at best shown in FIGS. 3–5. The lower running gear assemblies 34 and 36 are attached to opposite ends of vehicle chasis 39, shown in phantom in FIGS. 4 and 5, and are located within a centrally disposed channel-shaped recess 40 which extends the length of the cab 25 along the underside thereof. The upper wheel assembly 38 is likewise located within a similar, central disposed channel-shaped recess 42 extending from front to back along the top of the cab 25 in parallel alignment with the recess 40.

Each of the lower running gear assemblies 34 and 36 includes an electric drive motor 44 attached to chasis 39 which powers a drive axle 48 through the intermediary of a reduction gear box 50. The drive axle 48 which extends from opposite ends 52 and 54 of the reduction gear box 50, has a pair of double-groove pulleys 56 and 58 affixed to its respective ends.

A bifurated suspension framing 60 includes opposed arms 62 and 64, each of which are pivotally attached at one end thereof to opposite ends 52 and 54 of reduction gear box 50. Arms 62 and 63 are joined to form a platform 66 having an upper surface substantially parallel to the plane of chasis 39. An air spring suspension 68 is positioned between platform 66 and chasis 39 which seems to reduce the effect of the vertical shocks transmitted from the bottom rail 14 during movement of the vehicle 12 thereover.

The suspension framing 60 has a pair of mutually aligned circular apertures 70 and 72 extending through arms 62 and 64, respectively. A main axle 74 is fitted into apertures 70 and 72 by means of appropriate bearings (not shown) in any conventional manner. Integrally fitted to axle 74 are a pair of double groove pulleys 76 and 78 disposed at opposite ends thereof. Two pairs of V-belts 80 and 82 interconnect pulleys 56 and 58 on drive axle 48. The use of V-belts enables the elimination of expensive differentials and 90 degree gear drives which would be used in heavier vehicles. A main drive wheel 84 is rotatably supported at the center of axle 74.

The construction of the bottom running tractive rail 14 is best shown in FIG. 4. Bottom rail 14 includes a hollow tubular base 94 having a rectangular configuration. A rail member 96 having a generally T-shaped cross section extends upward from an upper surface of base 94 along the length thereof. The rail member 96 constitutes the running surface for the main drive wheels 84 of the vehicle 12.

The upper wheel assembly 38, also shown in FIG. 3, includes a lateral servomechanism 102 having a laterally movable carriage 104. Carriage 104 is continuously positionable along a guideway 106 by a controller 108 in accordance with vehicle speed and rail curvature during travel of the vehicle 12. A vertical servomechanism 110 includes a vertically movable piston type carriage which is continuously positionable in a guide cylinder 112 fixed to carriage 104 of the lateral servomechanism 102 by a controller 113 in accordance with the rail slope and traction conditions between the lower rail 14 and the motor drive wheels. Each of servomechanisms 102 and 110 may be any known type which is adaptable for use with the vehicle such as, for example, an analog, relay or digitally based electrical or fluid system.

Figure 10:
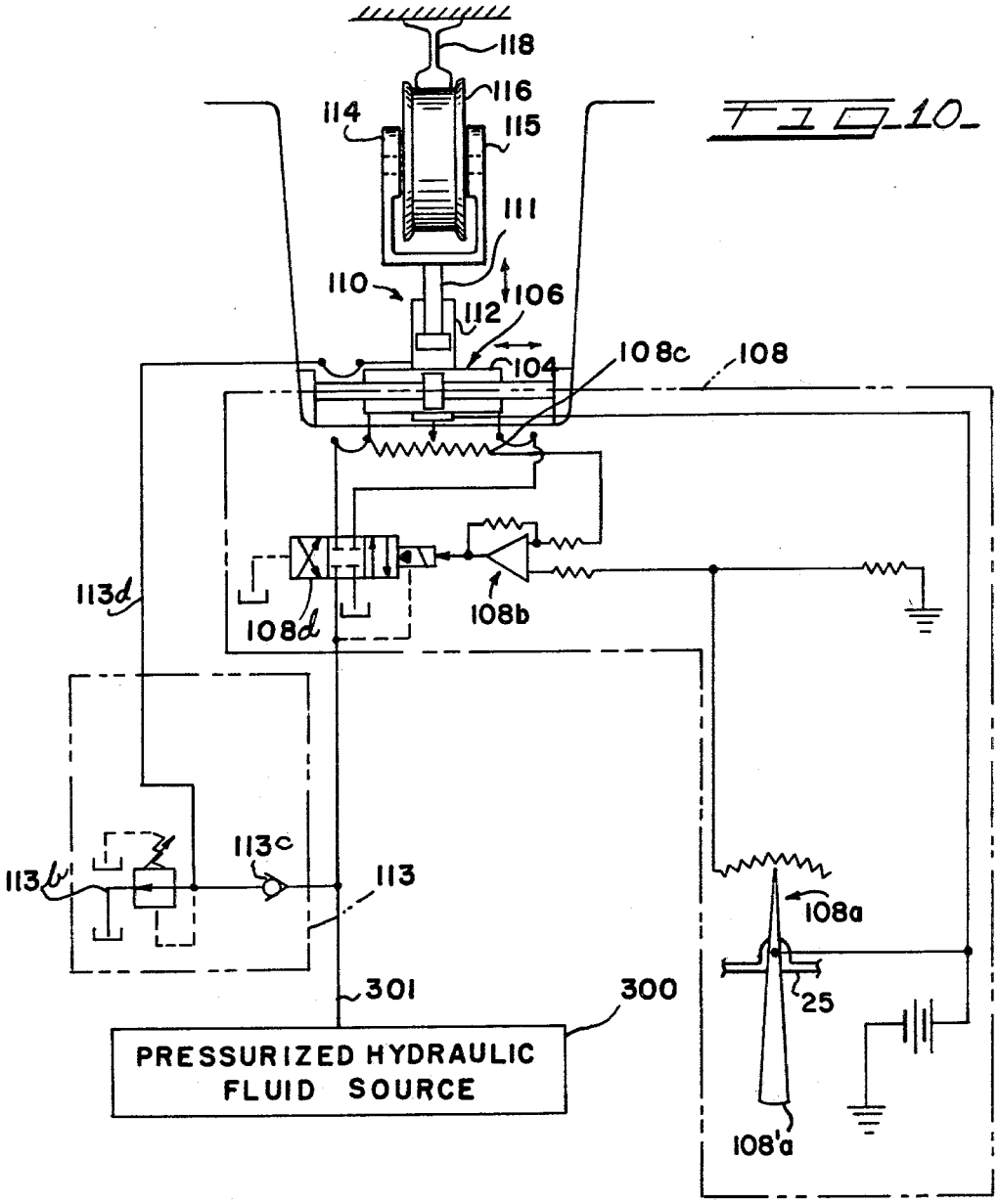
FIG. 10 is a schematic diagram showing controllers of the vertical and lateral servomechanisms illustrated in FIG. 3.

The servomechanisms 102 and 100 and the associated controllers 108 and 113 which are generally outlined by phantom lines in FIG. 10 utilize a common pressurized fluid source 300 such as the hydraulic system of the vehicle to move and maintain the wheel assembly 38 in position as desired.

As can be seen from FIG. 10, the controller 108 is a typical closed loop feedback control system. The system regulates the flow of hydraulic fluid to move th carriage 106 as discussed above by means of a two stage servo valve 108*d* which is controlled by an electrical signal from a servo amplifier 108*b* which compares and amplifies the electrical signals from a potentiometer 108*c* detecting the lateral position of the carriage 106 relative to the cab 25 and a tilt transducer 108*a* which is mounted on the vehicle cab 25.

The tilt transducer 108*a* is essentially an accelerometer which includes a reactive element such as a movable pendulum 108*a* or the like which is acted upon by the resultant of the centrifugal and gravitational forces acting on the cab to vary the signal eminating from the tilt transducer in proportion to the angular deviations between the vertical axis of the cab 25 and the axis of the resultant force which is dependent on rail curvature and the speed of the vehicle as it moves thru a curve.

The vertical controller 113 is a fluid type open loop control system. As illustrated in FIG. 10, an adjustable pressure regulator 113*b* is provided which is fed by the hydraulic line 301 thru a check valve 113*c* and connected to the feed line 113*d* such that adjustment of the regulator 113*b* by an operator or otherwise will increase or decrease wheel traction as desired.

The vertically movable carriage 111 includes a yoke 114 which is apertured to accommodate a horizontally disposed axle 115 which is suitably supported by bearings (not shown) in any conventional manner. An upper wheel 116 is rotatably supported on axle 115 in engagement with upper rail 16. Since the upper wheel 116 is not weight bearing and does not drive the vehicle 12, as does the main drive wheel 84, it may be of a smaller size but is otherwise identical to the main drive wheel 84.

As shown in FIGS. 3 and 7, the upper stabilizing rail 16 includes a longitudinally running shroud 124 having an upper ceiling portion 126 affixed to upper arms 24 of respective support posts 18 and a pair of opposed parallel sidewalls 128 and 130 extending downward from the upper portion 126. Electrical circuit contacts 132, 133 and 134 having electrically insulating mounts 135 and upper rail member 118 are fixedly attached to the underside of shroud 124 in a longitudinally extending parallel array. The shroud 124 constitutes a stiffening and supporting structure for the upper rail member 118 and electrical contacts 132, 133 and 134 in addition to protecting them from the environment (e.g., ice storms).

As shown in FIG. 7, vehicle 12 includes an electrical pick-up assembly 137 disposed within the upper channel-shaped recess 42. Pickup assembly 137 includes a plurality of electrical pickup contacts 138, 140 and 142 in continuous contact with electrical circuit contacts 132, 133 and 134, respectively, and a ground pick up contact 144 in continuous contact with upper rail member 118. Contacts 138, 140, 142 and 144 are suitably supported and mutually insulated by a support member 146 affixed to cab 25 within recess 42. The electric motors 44 and any electrical accessories such as vehicle lights and the like are electrically connected to contacts 138, 140, 142 and 144 and are powered thereby.

With reference to FIG. 6, an emergency brake assembly 150 for vehicle 12 includes a pair of opposed roller assemblies 152 and 154 disposed on the bottom running tractive rail 14 and carrying a brake shoe 156 therebetween. Roller assemblies 152 and 154 are identically constructed, each including a roller wheel 158 rotatably supported by an armature 160 having a pair of opposed parallel arms joined at a center 162 in a hairpin-like configuration as viewed from above. Each of the opposed arms of armature 160 supports a respective end of a pivot pin 164 extending therebetween.

A brake pad 165 is fixedly carried by brake shoe 156 along a lower surface thereof. The brake shoe 156 includes a pair of upward extending boss members 166 and 168 disposed at opposite ends thereof. Each of the boss members 166 and 168 extends between the arms of a respective armature 160 and is pivotally linked thereto by pivot pin 164. Thus, the brake shoe 156 and brake pad 165 carried thereby are evenly supported by roller assemblies 152 and 154 parallel to the upper surface of the bottom running tractive rail 14.

Each roller assembly 152 and 154 also includes a spring 170 disposed in compression between the center 162 of armature 160 and an upper surface of brake shoe 156. The springs 170 serve to position the brake pad 165 off of the upper surface of the bottom rail 14 during normal running of vehicle 12 when the brake system is not in use.

The brake assembly 150 also includes a saddle 172 having an upper ceiling member 174 disposed over the brake shoe 156 and a pair of opposed parallel side walls 176 and 178 depending therefrom. Ths side walls 176 and 178 are disposed within like opposed rectangular shaped recesses 180 in the sides of brake shoe 156 to facilitate close spacing to the sides of the bottom rail 14. An opposed pair of lower lip members 180 extend inward from the bottoms of respective side walls 176 and 178 to a position beneath the underside of the running surface of the tractive rail 14.

A fluid charged hydraulic cylinder 182 having a fluid actuable piston 183 therein is centrally positioned between the upper ceiling member 174 and brake shoe 156 with its axis of force directed vertically. Cylinder 182 includes a fluid inlet 184 through which additional fluid flows during braking.

A pair of forward projecting arms 190 are fixedly attached to a leading edge of brake shoe 156 on opposite sides of the forward roller wheel 158. A link 192 is pivotally attached at one end thereof to arms 190 by a pivot pin 194 and at its opposite end to a bracket 196 extending from the car body by the pivot pin 198. As shown in FIGS. 1 and 2 the bracket 196 and brake assembly 150 are disposed within recess 40 toward the rear of vehicle 12 intermediate the pair of lower running gear assemblies 34 and 36.

The construction of the main drive wheel 84 and the smaller diameter upper wheel 116 is illustrated in FIGS. 8 and 9. As shown, each of wheels 84 and 116 includes a circular running member 210 having an axle receiving aperture 212 centrally positioned relative to a circumferential running surface 214. The running member 210 is circularly recessed on opposite sides thereof, at 216 and 218, to accommodate a pair of circular flanges 220 and 222, respectively. The circular flanges 220 and 222 are retained on opposite sides of running member 210 by a pair of locking rings 224 and 226. The locking rings 224 and 226 are fastened to the running member 210 by a plurality of bolts 227 disposed in a circular array and having threaded ends which are retained in threaded apertures 228 in opposed sides of running member 210.

The circular flanges 220 and 222 are spaced from the sides of running member 210 by ring-shaped spacers 230 and 232 which act as bearings. The locking rings 224 and 226 and circular flanges 220 and 222 are likewise spaced from each other by ring-shaped spacers 234, 236, 238 and 240 which also act as bearings. Thus, the circular flanges 220 and 222 are retained by locking rings 224 and 226 such that they are each independently rotatable relative to the circular running member 210.

In operation, electrical current from the electrical circuit contacts 132, 133 and 134 on the upper stabilizing rail 16 energizes the electric drive motor 44 upon the actuation of a suitable controller (not shown). The outputs of motors 44 are geared down by the reduction gear boxes 50 and applied, via drive axle 48 and pulleys 56 and 58 thereon, to drive the V-belts 80 and 82. The pulleys 76 and 78 and main axle 74 are rotated by the V-belts 80 and 82 to thereby rotate the main drive wheels 84 carried thereby, thus causing vehicle 12 to commence forward movement along rail assembly 10. The direction of forward movement is from left to right with reference to FIG. 1.

During movement of vehicle 12, the vertically extendable servomechanism 110 operates to vertically wedge the upper and lower wheels 116 and 84 against their respective rails 16 and 14. Consequently, the normal frictional force component between the main drive wheels 84 and the lower tractive rail 14 is commensurately increased by an amount equal to the magnitude of the portion of the wedging force carried by each drive wheel 84. This increases the frictional engagement between the drive wheels 84 and the bottom running tractive rail 14 which thereby results in improved wheel traction.

The vertically extendable servomechanism 110 is also continuously variable in accordance with the diverse track conditions encountered during movement of vehicle 12. Thus, by further increasing the wedging force and, consequently, the frictional engagement between both the upper wheel and its guide rail and drive wheels 84 and bottom rail 14, the vehicle 12 can be made to climb track slopes of greater steepness than would otherwise be possible. In addition, such variable control of the wedging force enables the acceleration, deceleration and braking of the vehicle to likewise be more closely controlled. This is particularly important since the vehicle 12 is intended for use in a rail system having a number of closely spaced individually powered vehicles operating at relatively high speeds.

During movement of vehicle 12 around curved stretches of the rail assembly 10, centrifugal forces acting thereon tend to shift passengers and freight radially outward in proportion to the radius of the curve and the speed of the vehicle 12. The lateral servomechanism 102 monitors these parameters and operates as an automatic feedback control to continuously position the laterally movable carriage 104 along guideway 106 in accordance with commands from the controller 108. Since the upper wheel 116 remains in contact with the upper rail 118, the movement of carriage 104 causes the body of vehicle 12 to tilt inward to the curve of rail assembly 10. By tilting the body of vehicle 12, its vertical axis is aligned in a direction substantially parallel to that of the resultant of the centrifugal force and gravity acting on vehicle 12. As a result, there is no laterally outward force component with respect to the vertical axis of vehicle 12, and accordingly, the tendency of passengers or freight to shift laterally is eliminated.

The vehicle 12 may be brought to a gradual stop by terminating the current to the drive motors 44. However, for more immediate, emergency stops the emergency brake assembly 150 of FIG. 5 is employed. In the use of the emergency brake assembly, which during travel of vehicle 12 is moving from left to right as seen in FIG. 6, braking is commenced by operating a suitable actuator (not shown) to force additional hydraulic fluid through fluid inlet 184 into cylinder 182. The additional fluid moves the piston 182 and brake shoe 156 downward toward the tractive rail 14 while simultaneously moving cylinder 182 and saddle 172 upward. Thus, the brake pad 165 is moved by brake shoe 156 downward into frictional braking contact with the upper surface of tractive rail 14 while the lip members 180 of saddle 172 are moved upward into contact with an under surface of tractive rail 14, as indicated by the directional arrows in FIG. 6, to thereby effect a clamping type of braking action to stop vehicle 12.

Inasmuch as the present invention is subject to many variations, modifications and changes in detail, it is intended that all matter contained in the foregoing description or shown in the accompanying drawings shall be interpreted as illustrative and not in a limiting sense.

What is claimed is:

1. A rail vehicle operable between a lower tractive rail and an upper stabilizing rail of a rail system comprising;

a vehicle body;

wheel means supporting the body for rotatable movement on the lower tractive rail;

an upper stabilizing wheel on said body and being vertically positioned for rotatable contact with the upper stabilizing rail; and means movably laterally positioning the upper stabilizing wheel relative to said body whereby the body may be laterally shifted relative to the upper rail and thereby vertically align the body with the resultant of centrifugal and gravitational forces acting thereon during movement along the rail system.

2. The rail vehicle of claim 1 wherein the means laterally positioning the upper stabilizing wheel relative to the body comprises a servomechanism including carriage means laterally positioning the upper wheel relative to the body and a controller positioning the carriage means in accordance with conditions encountered during movement along the rail system.

3. The rail vehicle of claim 1 wherein the wheel means supporting the body on the lower tractive rail includes a plurality of running gear assemblies, each comprising:

a suspension means;

a main drive wheel having independently rotatable flanges rotatably carried by the suspension means;

an electric drive motor; and belt drive means powered by the electric drive motor to effect rotation of the main drive wheel and thereby move the vehicle along the rail system.

4. The rail vehicle of claim 1 wherein the upper stabilizing wheel includes a pair of independently rotatable wheel flanges.

5. The rail vehicle of claim 1 further comprising an emergency brake assembly attached to the body and operable to clamp the lower tractive rail during braking.

6. The rail vehicle of claim 1 wherein the wheel means comprises front and back wheels, each having a pair of independently rotatable wheel flanges.

7. The rail vehicle of claim 1 further comprising a drive motor and belt means powered by the drive motor means for driving the wheel means to effect movement of the vehicle along the rail system.

8. A rail vehicle operable between a lower tractive rail and an upper stabilizing rail of a rail system comprising:

a vehicle body wheel means supporting the body for rotatable movement on the lower tractive rail;

an upper stabilizing wheel on said body and being movably positioned for rotatable contact with the upper stabilizing rail; and means movably vertically positioning said upper stabilizing wheel relative to said wheel means supporting the body for varying frictional engagement between the wheel means supporting said body and the lower tractive rail in accordance with traction requirements along the rail system.

9. The rail vehicle of claim 8 wherein the means vertically positioning the upper stabilizing wheel relative to said wheel means supporting the body comprises a servomechanism including carriage means vertically positioning the upper wheel relative to the body and a controller positioning the carriage means in accordance with conditions encountered during movement along the rail system.

10. For use in an elevated electric rail system including a lower tractive rail and an upper stabilizing rail having a plurality of electric contacts carried thereby, an electrically powered rail vehicle comprising:

a vehicle body having a chassis;

a plurality of running gear assemblies supporting the body by its chasis for movement along the lower tractive rail;

an upper stabilizing wheel supported on the body for rotatable contact with the upper stabilizing rail;

an electrical pickup assembly carried by said body including a plurality of electrical pickup contacts matable with the electrical contacts on the upper stabilizing rail;

an emergency brake assembly attached to the body and operable to clamp the lower tractive rail during braking; and a lateral control servomechanism including a carrier means operable to movably laterally position the upper stabilizing wheel relative to the body in accordance with vehicle speed and rail curvature to thereby laterally tilt the body relative to the lower tractive rail to direct centrifugal forces thereon downwardly relative to the body during movement along the rail system and to maintain an effective relationship between the body and brake assembly.

11. The rail vehicle of claim 10 further comprising:

a vertical servomechanism including a carriage means operable to movably vertically position the upper stabilizing wheel relative to the running gear assemblies whereby the frictional engagement between the running gear assemblies supporting the body and the lower traction rail may be varied in accordance with traction requirements along the rail system.

12. The rail vehicle of claim 11 wherein said lateral servomechanism includes a lateral guideway and a carriage movable thereover; and said vertical servomechanism is carried on said carriage and includes a vertically extendable piston, a yoke supported on the piston, and the upper stabilizing wheel rotatably supported by the yoke.

13. The rail vehicle of claim 10 wherein each of said running gear assemblies comprises:

an electric drive motor carried by the body chassis and energizable through the electric pickup contracts by the electrical contacts on the upper stabilizing rail;

a reduction gear box driven by the drive motor and having an upper drive axle;

pulley means on said drive axle;

an air spring disposed beneath the body chassis;

a suspension framing member having one end pivotally attached to the reduction gear box and another end abutting the air spring;

a main drive wheel having independently rotatable flanges;

a main axle rotatably supported by the suspension framing member and having the main drive wheel thereon;

another pulley means on the main axle; and belt drive means interconnecting the respective pulley means of the drive axle and the main axle.

14. The rail vehicle of claim 10 wherein said emergency brake assembly comprises:

a brake shoe having a brake pad thereon;

a saddle member having a clamping lip thereon;

a hydraulic cylinder having a fluid actuable piston interconnecting the brake shoe and saddle member for relative movement therebetween in accordance with actuation of said piston during braking to thereby clamp the lower tractive rail between the brake pad and saddle lip;

roller assembly means pivotally attached to the brake shoe for rollably moving same along the lower tractive rail.

15. A rapid transit system comprising:

a vertical rail system including a lower tractive rail and shroud means;

said shroud means including an upper stabilizing rail parallel to said lower tractive rail, electrical contact means adjacent to said upper rail; and a hood encompassing the upper rail and electrical contact means in supporting and weather protective relation, a rail vehicle disposed between said lower and upper rails including a vehicle body and wheel means having a plurality of lower wheels rollable on the lower rail and an upper stabilizing wheel rollable along the upper rail;

means for driving the vehicle including an electric motor energized through the electrical contact means; and means for moving the upper wheel relative to the vehicle body and wheel means to compensate for conditions encountered during movement of the rail vehicle.

16. The rapid transit system of claim 15 wherein the hood includes a ceiling portion having the upper rail and electrical contacts affixed thereunder and a pair of opposed sidewalls depending from the ceiling portion.

17. The rapid transit system of claim 15 wherein the means for moving the upper wheel relative to the vehicle body comprises a servomechanism including a carriage laterally positioning the upper wheel relative to the vehicle body in response to the effect of centrifugal force exerted on the vehicle body during movement thereof.

18. The rapid transit system of claim 17 wherein the means for moving the upper wheel relative to the vehicle body further comprises a servomechanism including a vertically movable carriage positioning the upper wheel relative to the vehicle body in response to diverse rail conditions encountered during movement of the rail vehicle.

* * * * *